US008869427B2

(12) United States Patent
Cetinkaya et al.

(10) Patent No.: US 8,869,427 B2
(45) Date of Patent: Oct. 28, 2014

(54) DRYER

(76) Inventors: Ertan Cetinkaya, Istanbul (TR); Ümit Gülbay, Istanbul (TR); Egeman Köse, Istanbul (TR); Sölen Özkan, Istanbul (TR)

( * ) Notice: Subject to any disclaimer, the term of this patent is extended or adjusted under 35 U.S.C. 154(b) by 948 days.

(21) Appl. No.: 12/676,351

(22) PCT Filed: Aug. 28, 2008

(86) PCT No.: PCT/EP2008/061330
§ 371 (c)(1),
(2), (4) Date: Sep. 30, 2010

(87) PCT Pub. No.: WO2009/030637
PCT Pub. Date: Mar. 12, 2009

(65) Prior Publication Data

US 2011/0010959 A1 Jan. 20, 2011

(30) Foreign Application Priority Data

Sep. 3, 2007 (TR) ..... a 2007 06083

(51) Int. Cl.
*D06F 58/02* (2006.01)
*D06F 37/02* (2006.01)

(52) U.S. Cl.
CPC ..... *D06F 37/02* (2013.01)
USPC ..... 34/602

(58) Field of Classification Search
USPC ..... 34/602; 68/16, 903
See application file for complete search history.

(56) References Cited

U.S. PATENT DOCUMENTS

| | | | | | |
|---|---|---|---|---|---|
| 1,645,971 | A | * | 10/1927 | Riegel | 72/370.08 |
| 2,929,674 | A | * | 3/1960 | Tann | 8/159 |
| 3,280,604 | A | | 10/1966 | Bent | |
| 3,358,302 | A | * | 12/1967 | Candor | 34/402 |
| 3,946,500 | A | * | 3/1976 | Barrett et al. | 34/139 |
| 6,105,533 | A | * | 8/2000 | Boos | 34/595 |

FOREIGN PATENT DOCUMENTS

| | | | |
|---|---|---|---|
| EP | 1420103 | A2 * | 5/2004 |
| GB | 2063311 | A | 6/1981 |
| JP | 2002-360989 | A | 12/2002 |
| WO | 2007023453 | A1 | 3/2007 |

* cited by examiner

*Primary Examiner* — Jiping Lu
(74) *Attorney, Agent, or Firm* — Venable, Campillo, Logan & Meaney PC

(57) ABSTRACT

A dryer having a drum, of high strength and which is easy to produce, is discussed such that the drum comprises a body formed b a rectangular metal sheet and a belt at the same length as the front side (K1) of the body, connected to said side through butt welding, and produced from a rectangular metal sheet with higher strength as compared with the body, said drum being constituted by bending and joining , so as to form a cylinder, the sides (K2, K3) that are perpendicular to the side (K1) connecting the body and the belt.

5 Claims, 2 Drawing Sheets

DRYER

FIELD

The present invention relates to a dryer comprising a drum.

BACKGROUND

As is known, in dryers, laundry to be dried is loaded inside a drum. A drying process is performed by the spinning of said drum driven by a motor In the state of the art, for the fabrication of these drums, a rectangular metal sheet is bent into a cylindrical form and the sides in juxtaposition are joined together along a line by way of butt-welding or one of the locking methods in order to constitute the body. Then, after mounting circular metal sheets to function as covers to the front and back thereon, said parts are shaped out through an expansion process, and the drum is obtained.

In the state of the art, Patent Application No WO2007023453 describes an embodiment wherein the drum body and the front and back covers are joined together by means of a locking method.

In another state of the art embodiment, Great Britain Patent Application No GB2063311 describes an embodiment wherein the front and back covers are connected onto the body by means of spot welding.

The front of a drum necessitates, however, high strength particularly in the case of dryers wherein frontal bearing is provided through a wheeled system. Yet, producing a drum completely out of a thicker and a more resistant material, in order to resolve this problem, brings about a cost increase.

SUMMARY

The aim of the present invention is the realization of a dryer comprising a drum, which is highly resistant but easy to produce.

The dryer realized in order to attain the aim of the present invention is explicated in the attached claims.

The drum of the invention comprises a body formed by a rectangular metal sheet and a belt with the same length as the body front side but with higher strength than that of the body. To produce said drum, the belt is first attached to the front side of the body through a welding. Next, the body and the belt are bent to form a cylinder so as to obtain the sides which are perpendicular to the connective side be arranged oppositely and are then joined together from these sides facing one another. This way, the front part of the body, where the wheels touch, is provided with strength to wearing and corrosion, but without causing any significant increase in the total cost of the material.

Once connection processes are completed, the front and the back of the drum are shaped out through an expansion process.

In one embodiment of the invention, the belt is fabricated from the same material as the body but is thicker. This way, a greater strength is provided to the belt without using a different material.

In another embodiment of the invention, the belt is fabricated out of a material different from that used for the body but at same thickness, said material having a greater strength property. This enables a perfect correspondence of the body and the belt surfaces during a welding process, also preventing an uneven line to form over the drum interior surface due to thickness difference.

The present invention provides cost advantage in dryers wherein the drum front is seated over wheels providing support thereto, because the metal sheet constituting the drum is produced with a more resistant material only there where the drum front leans against the wheels.

BRIEF DESCRIPTION OF THE DRAWINGS

A dryer realized in order to attain the aim of the present invention is illustrated in the attached figures, where.

DETAILED DESCRIPTION

The elements illustrated in the figures are numbered as follows:

1. Dryer
2. Tub
3. Drum
4. Body
5. Belt
6. Wheel

Figure 1:
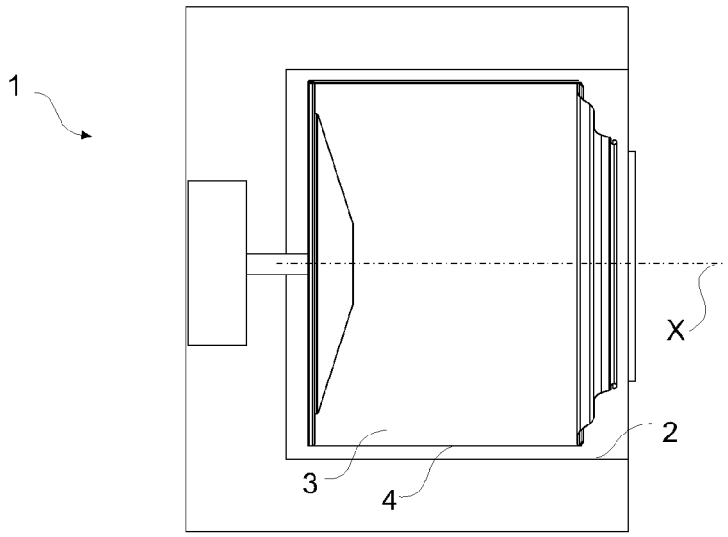
FIG. 1—represents a schematic view of a dryer.
Figure 2:
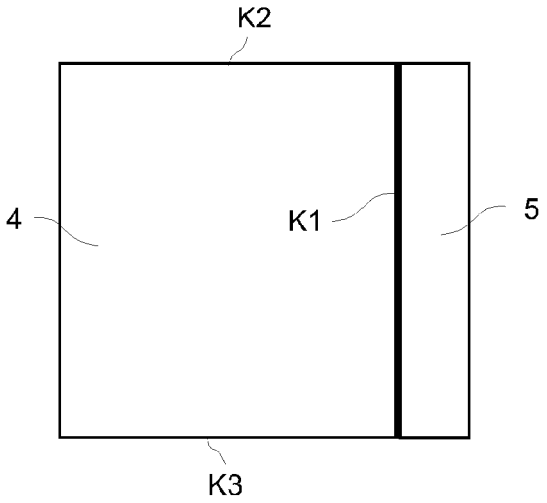
FIG. 2—represents a view of the sheets that make up the belt and the body in joint position before the constitution of the drum.
Figure 3:
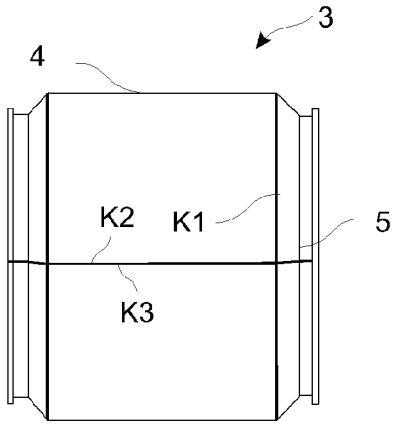
FIG. 3—represents a side view of the drum shaped out through expansion process.

The dryer (1) of the invention comprises a tub (2) and a drum (3) which is placed inside said tub (2) and which rotates about own axis (FIG. 1). The dryer (1) of the present invention is preferably a dryer (1) with a horizontal axis.

The drum (3) comprises a body (4) fabricated from a rectangular metal sheet and a belt (5) which has the same length as the front side (K1) of the body (4), which is connected to said side (K1) by butt welding, and which is produced from a rectangular metal sheet provided with greater strength force as compared with the body (4); and is constituted by bending the body (4) and the belt (5) to form a cylinder in such a way that the sides (K2, K3) perpendicular to the connective side (K1) are arranged oppositely and by joining together from these sides (K2, K3) that face one another. This way, an area is created on the drum (3) front side which is more resistant to wearing during the length of usage.

Figure 4:
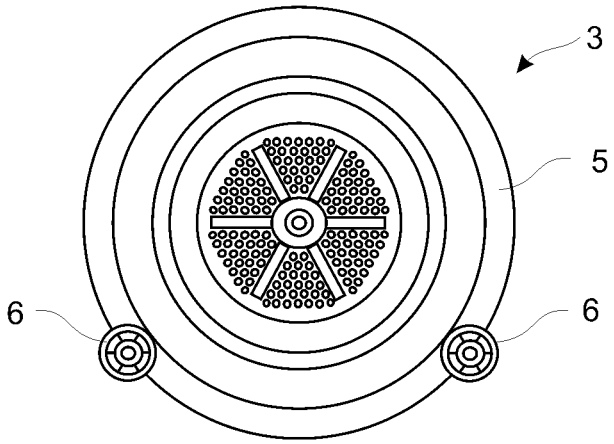
FIG. 4—represents a front view of the drum and the wheels.

When connection processes are completed, the front and back of the drum (3) are shaped out through an expansion process. The area that is shaped is the front part of the drum (3) which is where the belt (5) is arranged (FIG. 4).

The dryer (1) which constitutes the object of the invention comprises one or more wheels (6) whereupon the front part of the drum (3) is seated, which, during a drying process, are driven to rotate about own axis by the rotary motion of the drum (3), which provide thus a support to the drum (3). Said wheels (6) lean against a belt (5). The belt (5), which is more resistant than the body (4), remains less sensitive to pressure exerted by the rotating wheels (6) and to the wearing effect due to such pressure.

In one embodiment of the invention, the belt (5) is fabricated from the same material as the body (4) but is thicker. This way, the belt (5) is provided with higher strength than the body (4) in spite of being manufactured out of the same material.

In one other embodiment of the invention, the belt (5) is provided with exactly the same thickness as the body (4) but is fabricated out of a different material having higher strength. This prevents the formation of thickness differences over the interior surface of the drum (3) while joining the body (4) and the belt (5) during a welding process.

The dryer (1), which constitutes the object of the present invention implements a drum (3) more resistant to wearing effect and to consequent breaks that are caused by the pressure of the wheels (6) over the front side thereof.

The invention claimed is:

1. A dryer comprising a tub (2) and a drum (3) placed inside the tub (2), the drum (3) rotating on a horizontal axis, and wherein the drum (3) comprises a rectangular metal sheet having a front side length (K1) and a belt (5) made from another rectangular metal sheet having greater strength compared with the rectangular metal sheet and having a side equivalent in length to the front side (K1) and wherein the front side (K1) of the rectangular metal sheet is coupled to the side of the belt thereby forming sides (K2, K3) perpendicular to the coupled front side (K1) and side of the belt and wherein the drum (3) is formed as a cylinder by bending the coupled rectangular metal sheet and belt and connecting the sides (K2, K3) and further comprising wheels (6) which lean against the said belt (5) and whereupon the front part of the drum (3) is seated and which, driven by the rotating motion of the drum (3), rotates around own axis during drying, proving therefore support to the said drum (3).

2. The dryer (1) as in claim 1, wherein the drum (3) further comprising a front and a back shaped out through an expansion process.

3. The dryer (1) as in claim 1 or 2, wherein wherein the rectangular metal sheet and the another rectangular metal sheet are equivalent material, but the another rectangular metal sheet forming the belt is thicker than the rectangular metal sheet.

4. The dryer (1) as in claim 1 or 2, wherein the another rectangular metal sheet is equal in thickness to the rectangular metal sheet, but the another rectangular metal sheet forming the belt (5) is fabricated out of a different material with higher strength than the rectangular metal sheet.

5. The dryer (1) as in claim 2, wherein the drum (3), wherein the shaped front part corresponds to the area in which the belt (5) is arranged.

* * * * *